US008132574B2

(12) United States Patent
Baker et al.

(10) Patent No.: US 8,132,574 B2
(45) Date of Patent: Mar. 13, 2012

(54) HAIR TREATMENT APPLICATOR FOR PROVIDING HAIR STRAND EFFECTS

(75) Inventors: Paul Edmund Baker, Silchester (GB); Robert Wayne Glenn, Jr., Liberty Township, OH (US); Simon Paul Godfrey, Uxbridge (GB); Rachel Gott, Pontefract (GB); Gemma Amelia Louise Salkeld, Twickenham (GB); Paul James Smith, Twickenham (GB)

(73) Assignee: The Procter & Gamble Company, Cincinnati, OH (US)

( * ) Notice: Subject to any disclaimer, the term of this patent is extended or adjusted under 35 U.S.C. 154(b) by 755 days.

(21) Appl. No.: 12/135,277

(22) Filed: Jun. 9, 2008

(65) Prior Publication Data

US 2009/0084394 A1 Apr. 2, 2009

(30) Foreign Application Priority Data

Jun. 15, 2007 (EP) ..... 07110392

(51) Int. Cl.
*A45D 19/18* (2006.01)

(52) U.S. Cl. ..... 132/270; 132/208

(58) Field of Classification Search ..... 132/208, 132/108, 270
See application file for complete search history.

(56) References Cited

U.S. PATENT DOCUMENTS

| | | | | |
|---|---|---|---|---|
| 2,272,409 | A | | 2/1942 | Johnson |
| 2,310,295 | A | | 2/1943 | Keele |
| 2,776,667 | A | | 1/1957 | Fitzgerald |
| 3,030,968 | A | | 2/1960 | Oberstar |
| 2,962,031 | A | | 11/1960 | Bumgarner |
| 3,662,767 | A | | 5/1972 | Murtha |
| 3,702,508 | A | | 11/1972 | Netter |
| 3,921,647 | A | | 11/1975 | Fisher |
| 4,020,854 | A | | 5/1977 | Caruso |
| 4,108,184 | A | | 8/1978 | Morganroth |
| 4,398,549 | A | | 8/1983 | Thomas |
| 4,503,870 | A | | 3/1985 | Peterson |
| 4,796,812 | A | | 1/1989 | Grollier |
| 4,942,893 | A | * | 7/1990 | Trottier ..... 132/270 |
| 5,042,514 | A | | 8/1991 | Bastien |
| 5,060,679 | A | | 10/1991 | Christopher et al. |
| 5,279,313 | A | | 1/1994 | Clausen |
| 5,535,764 | A | | 7/1996 | Abramson |
| 5,554,197 | A | | 9/1996 | Assini |
| 5,771,906 | A | | 6/1998 | De Benedictis |
| 5,823,204 | A | | 10/1998 | Todd |
| 5,848,730 | A | | 12/1998 | Kawase |
| 5,971,645 | A | | 10/1999 | Fukushima |
| 6,062,231 | A | | 5/2000 | De LaForcade |
| 6,148,829 | A | | 11/2000 | De Benedictis |

(Continued)

FOREIGN PATENT DOCUMENTS

DE 662702 C1 7/1938

(Continued)

*Primary Examiner* — Rachel Steitz
(74) *Attorney, Agent, or Firm* — Carl J. Roof

(57) ABSTRACT

The present invention relates to a hair treatment applicator (1), which comprises a plate (10) and a containment portion (20) movably joined by a connection (30) so that said applicator (1) may alternate between a closed state and an open state. At least one member (40), which is continuous and liquid impervious, projects from the substantially flat internal surface (101) of the plate (10). The hair treatment applicator according to the invention allows for precise, non-messy and even application of a hair treatment composition to the hair, in particular to a hair strand and preferably to a bundle of hair strands.

11 Claims, 6 Drawing Sheets

U.S. PATENT DOCUMENTS

| | | | | |
|---|---|---|---|---|
| 6,250,312 | B1 | 6/2001 | Dasilva | |
| 6,427,701 | B1 | 8/2002 | Roth | |
| 6,440,175 | B1 | 8/2002 | Stanley | |
| 6,626,599 | B2 | 9/2003 | Delaforcade | |
| 6,748,957 | B1 | 6/2004 | Giordano | |
| 7,025,069 | B2 | 4/2006 | Thiebaut | |
| 7,198,049 | B2 | 4/2007 | Elmer | |
| 7,357,137 | B2 | 4/2008 | Husband | |
| 7,425,220 | B2 | 9/2008 | Barrass | |
| 7,475,688 | B2 | 1/2009 | Colacioppo | |
| 7,543,591 | B1 | 6/2009 | Munsil | |
| 2002/0114657 | A1 | 8/2002 | Gueret | |
| 2002/0142027 | A1 | 10/2002 | Gueret | |
| 2002/0179109 | A1* | 12/2002 | Lenzi-Brangi et al. | 132/208 |
| 2003/0007825 | A1 | 1/2003 | De Laforcade | |
| 2004/0016064 | A1 | 1/2004 | Vena | |
| 2004/0031502 | A1 | 2/2004 | Winckels | |
| 2004/0089316 | A1 | 5/2004 | Hamilton | |
| 2004/0182408 | A1 | 9/2004 | De LaForcade | |
| 2005/0079192 | A1 | 4/2005 | Simon | |
| 2005/0207153 | A1 | 9/2005 | Leleve | |
| 2005/0211599 | A1 | 9/2005 | De LaMettrie | |
| 2006/0042643 | A1 | 3/2006 | Delan | |
| 2006/0064824 | A1 | 3/2006 | Godfrey | |
| 2006/0090771 | A1 | 5/2006 | Ramet | |
| 2006/0144415 | A1 | 7/2006 | Magee | |
| 2006/0207036 | A1 | 9/2006 | Kennedy | |
| 2007/0144550 | A1 | 6/2007 | Roher | |
| 2007/0215170 | A1 | 9/2007 | Kennedy | |
| 2007/0227620 | A1 | 10/2007 | Kunii | |
| 2008/0000492 | A1 | 1/2008 | Mills | |
| 2008/0083418 | A1 | 4/2008 | Glenn | |
| 2008/0083419 | A1 | 4/2008 | Glenn | |
| 2008/0083420 | A1 | 4/2008 | Glenn | |
| 2008/0087292 | A1 | 4/2008 | Abergel | |
| 2008/0087293 | A1 | 4/2008 | Glenn | |
| 2008/0087294 | A1 | 4/2008 | Glenn | |
| 2008/0110929 | A1 | 5/2008 | Stanley Traasdahl et al. | |
| 2008/0156817 | A1 | 7/2008 | Roseblade | |
| 2008/0196734 | A1 | 8/2008 | Husband | |
| 2008/0223386 | A1 | 9/2008 | Albisetti | |
| 2008/0223391 | A1 | 9/2008 | Baker | |
| 2008/0223393 | A1 | 9/2008 | Boyle | |
| 2008/0257370 | A1 | 10/2008 | Perry | |
| 2008/0308119 | A1 | 12/2008 | Smith | |
| 2009/0050171 | A1 | 2/2009 | Barrass | |
| 2009/0071496 | A1 | 3/2009 | Glenn | |
| 2009/0084393 | A1 | 4/2009 | Baker | |
| 2009/0084394 | A1 | 4/2009 | Baker | |
| 2009/0084395 | A1 | 4/2009 | Glenn | |
| 2009/0095314 | A1 | 4/2009 | Lund | |
| 2009/0101159 | A1 | 4/2009 | Bonnafous | |
| 2009/0152281 | A1 | 6/2009 | Bowes | |
| 2009/0223531 | A1 | 9/2009 | Lund | |

FOREIGN PATENT DOCUMENTS

| | | | |
|---|---|---|---|
| DE | 197639177 | U1 | 4/1977 |
| DE | 198805283 | U1 | 7/1988 |
| DE | 3138389 | C2 | 7/1990 |
| DE | 4041742 | A1 | 6/1992 |
| DE | 29616331 | U1 | 12/1996 |
| DE | 29917054 | U1 | 8/2000 |
| DE | 10259016 | A1 | 6/2004 |
| DE | 202004017014 | U1 | 6/2005 |
| DE | 20221665 | U1 | 11/2006 |
| DE | 102005058188 | A1 | 6/2007 |
| DE | 202007016018 | U1 | 4/2008 |
| EP | 1138374 | A1 | 10/2001 |
| EP | 1566114 | A1 | 8/2005 |
| EP | 1264559 | B1 | 11/2005 |
| EP | 1897459 | A1 | 3/2008 |
| EP | 1915920 | A1 | 4/2008 |
| EP | 1481605 | B1 | 8/2009 |
| FR | 2444421 | A1 | 7/1980 |
| FR | 2495905 | A1 | 6/1982 |
| FR | 2854778 | A1 | 11/2004 |
| FR | 2905833 | A1 | 3/2008 |
| GB | 274875 | A | 10/1927 |
| GB | 2242357 | A | 10/1991 |
| GB | 2383944 | A | 7/2003 |
| GB | 2384425 | A | 7/2003 |
| JP | 4-41305 | | 4/1992 |
| JP | 11-178630 | | 7/1999 |
| JP | 11-178639 | A | 7/1999 |
| JP | 2001-211925 | A | 8/2001 |
| JP | 2002-034636 | A | 2/2002 |
| JP | 2003-199623 | A | 7/2003 |
| JP | 2003-310337 | A | 11/2003 |
| WO | WO 93/02589 | A1 | 2/1993 |
| WO | WO 93/10687 | A1 | 6/1993 |
| WO | WO 98/43511 | A1 | 10/1998 |
| WO | WO 02/074129 | A1 | 9/2002 |
| WO | WO 2006/010354 | A1 | 2/2006 |

* cited by examiner

HAIR TREATMENT APPLICATOR FOR PROVIDING HAIR STRAND EFFECTS

FIELD OF THE INVENTION

The present invention relates to an applicator which allows for precise, non-messy and even application of a cosmetic composition to keratinous fibres. The applicator according to the invention is especially intended for hair treatment compositions to provide hair strand effects.

BACKGROUND OF THE INVENTION

Application of hair treatment compositions to distinct hair strands allows the user to achieve a different look than a full head application. Hair treatment compositions for providing a hair strand effect include highlighting compositions, dyeing compositions, perming compositions, styling compositions and mixtures thereof.

Hair strand effects such as those provided by highlighting compositions and dyeing compositions must be precisely applied where desired. For example, if a too abundant amount of highlighting composition is applied to the root, it may transfer to the neighbouring unselected hair strands. This may alter the overall end result and may totally disrupt the pattern that the user has tried to create. In addition, hair treatment compositions such as highlighting and dyeing compositions comprise components that need strong oxidants to bleach the melanin pigments. In view of its reactive chemical nature, most applications of highlighting and dyeing compositions if unexpectedly delivered in excess to the root-line, may also transfer to the scalp which can lead in some cases to unnecessary skin irritation. In addition, if an excessive amount of product is applied to the root, the colour effect will not be consistent along the length of the hair, leading to an undesired visual effect. If, instead, insufficient composition is applied to the hair strands, the evenness of the hair strand effect may not be achieved producing an end result which is visually unacceptable. Hence it is important that a consistent amount of product is applied uniformly along the hair strands being treated.

One known method for providing hair strand effects such as highlighting is the cap and hook system. A cap, provided with holes, is positioned over the head and hair strands are pulled out with a hook. Far from being accurate, the cap and hook system suffers from several drawbacks including random selection of the hair strands via the holes on the cap and the likelihood of applying the highlighting composition to only a portion of the selected hair strands and not to the root portion.

Several hair treatment applicators have been designed for application of a hair treatment composition to independent bundles of hair strands as alternatives to the cap and hook system. These applicators belong to two general fields. One field comprises applicators based on combs and/or brushes. The other group comprises applicators having two articulated portions which are movable one relative to the other. Many attempts have been disclosed in this later field. U.S. Pat. No. 3,030,968 refers to an applicator for liquid treating material to be loaded by immersion. This applicator comprises a trough and a hair guide member mounted on the ends of the legs of a U-shaped resilient spring. The spring allows for manual compression and permits the hair guide member to fit into the trough. U.S. Pat. No. 6,062,231 discloses a device for applying a hair product to hair strands. This device comprises two articulated portions; the application means to be loaded by immersion and the retaining member to keep the hair strands on the applicator means while the device is in use. Another attempt is shown in US2003/0024544 wherein a device is disclosed provided with a cavity for the hair product and a retention member which is elastically deformable. The retention member may comprise porous or fibrous material and the cavity is provided with at least one notch to keep the hair strands in position during the application of the hair treatment composition.

It is generally recognized that the self-application of a composition to achieve hair strand effects are difficult per se, in particular those for highlighting and dyeing. To achieve the expected end results, a hair treatment applicator capable of facilitating the self-application of a hair treatment composition needs to be conceived to address several technical challenges.

Firstly, the hair treatment applicator should apply an amount of hair treatment composition, which is sufficient to provide a hair strand effect without transferring to neighbouring strands or the scalp and skin.

Secondly, the hair treatment applicator should not apply but then subsequently scrape off the hair treatment composition while the user moves the applicator along the bundle of hair strands.

Thirdly, highlighting and dyeing compositions in particular, are formulated so as to stay in place for a period of time long enough for the chemistry contained therein to provide the effects to the keratinous fibres. The hair treatment applicator should thus be designed to readily apply hair treatment compositions typically formulated as gel, cream or paste avoiding displacement and dripping out of the applicator while the user treats the hair.

Fourthly, the whole application process should occur in a tidy and clean fashion without the hair treatment composition being inadvertently displaced out of the hair treatment applicator.

In addition, the hair treatment applicator should not let the hair treatment composition remain unused or sequestered within the applicator. If the hair treatment composition is visually sequestered, it may increase the signal for the user to reload, thus inducing the user to load more hair treatment composition than the device may contain, leading to an increased risk of mess for the user during the application of the hair treatment composition.

Moreover, the hair treatment applicator should evenly apply the composition to independent bundles of hair strands. Evenness is very important when the composition is a highlighting or dyeing composition. The permanent effect provided by these compositions is not immediately visible after the application and if the result is not appealing, it is not easily reversed. A hair treatment applicator should hence ensure homogeneous coating along the length and width of the bundle of hair strands and likewise on the front and rear surfaces.

Finally, an applicator for hair treatment compositions should be easy to use; it should be doubtless cheap and easy to produce and it should not require any special experience and training in matters such as how much and where to load the hair treatment composition. Ideally, the consumer should be able to load and use the applicator by simply following a few instructions provided by the manufacturer.

Thus, what still remains to be solved in the art is a hair treatment applicator capable of overcoming the technical problem defined above.

It has now been found that a hair treatment applicator (as defined herein after) can significantly improve the application of a hair treatment composition to provide hair strand effects.

SUMMARY OF THE INVENTION

According to the invention, a hair treatment applicator (1) for applying a hair treatment composition to the hair, is provided wherein said applicator (1) comprises a plate (10) and a containment portion (20); wherein said plate (10) comprises a perimeter (103), a substantially flat internal surface (101) and an external surface (102); wherein said plate (10) comprises at least one member (40), which projects from said substantially flat internal surface (101); wherein said member (40) is continuous and liquid impervious; wherein said member (40) has a proximal base (41) and a distal base (42) wherein said proximal base (41) is attached to said substantially flat internal surface (101) of said plate (10) and wherein said distal base (42) comprises an edge (44); and wherein said containment portion (20) comprises a bottom (201) and a wall (202), said wall (202) emerging from said bottom (201) and extending upwardly, said wall (202) having a rim (222) and said rim (222) defining an opening (203) and an internal volume (204) of said containment portion (20); and wherein said plate (10) and said containment portion (20) are movably joined by a connection (30) so that said applicator (1) may alternate between a closed state and an open state, wherein when said applicator (1) is in a closed state, said substantially flat internal surface (101) of said plate (10) is in a juxtaposed relationship to said opening (203) of said containment portion (20) and wherein when said applicator (1) is in an open state, said substantially flat internal surface (101) of said plate (10) is in a distal relationship to said opening (203) of said containment portion (20); and wherein when said hair treatment applicator (1) is in said closed state, at least a part of said member (40) is within said internal volume (204) of said containment portion (20).

Furthermore, a method to treat the hair by means of the hair treatment applicator (1), a kit comprising the hair treatment applicator (1) and the use of a hair treatment composition to provide a hair strand effect with a hair treatment applicator (1) according to the invention are also described.

Finally, according to the invention, the use of the hair treatment applicator (1) to apply a hair treatment composition to a hair strand, preferably to a bundle of hair strands, is provided, wherein said use comprises locating said hair strand substantially straight between a plate (10), which comprises a member (40), and a containment portion (20) and then bending said hair strand to an angle $\phi$ with said member (40) within said containment portion (20); wherein said angle $\phi$ is from about 15° to 55°.

BRIEF DESCRIPTION OF THE DRAWINGS

In FIG. 2A a member (40) is shown which has a maximum length (L) which extends along said substantially flat internal surface (101) and along said axis Y. In FIG. 2B a member (40) is shown, which has a maximum length (L) which extends along said substantially flat internal surface (101) and substantially parallel to said axis Y. In FIG. 2C a member (40) is shown, which has a maximum length (L), which extends along said substantially flat internal surface (101) but extends oblique to said axis Y.

DETAILED DESCRIPTION OF THE INVENTION

Figure 1:
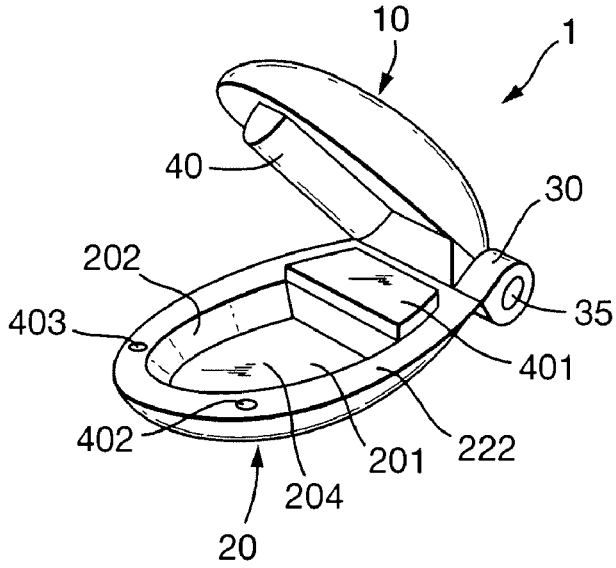
FIG. 1 is a perspective view of an embodiment of the hair treatment applicator (1) according to the invention. The hair treatment applicator is shown in an open state. A plate (10), which comprises a liquid impervious and continuous member (40) having a pyramidal frustum form, is movably joined to a containment portion (20) by a connection (30). Said connection (30) which comprises a fulcrum (35), is a hinge. On the rim (222) of said containment portion (20), two stop mechanisms are present and in this embodiment comprise two hemispheres (402, 403). A sealing means (401) is located within said internal volume (204) of the containment portion (20) on the bottom (201), adjacent to said wall (202) and to said connection (30).

The present invention is characterized by the synergistic relationship that the features as described herein have when combined together in the specific relationship selected within the present invention to solve the above technical problem.

The hair treatment applicator (1) according to the present invention comprises a plate (10) and a containment portion (20). Said plate (10) comprises a perimeter (103), a substantially flat internal surface (101) and an external surface (102), whereas the containment portion (20) is formed by a bottom (201) and a wall (202) emerging from said bottom (201) and extending upwardly. Said wall (202) has a rim (222) which defines the opening (203) and the internal volume (204) of said containment portion (20). A member (40), which is continuous and liquid impervious, projects from said substantially flat internal surface (101) of said plate (10). Said member (40) has a proximal base (41) which is attached to said substantially flat internal surface (101) of said plate (10) and a distal base (42), which comprises an edge (44). Said plate (10) and said containment portion (20) are movably joined by a connection (30) so that said applicator (1) may alternate between a closed state and an open state. In a closed state, said substantially flat internal surface (101) of said plate (10) is in a juxtaposed relationship to said opening (203) of said containment portion (20). In an open state, said substantially flat internal surface (101) of said plate (10) is in a distal relationship to said opening (203) of said containment portion (20). In said closed state, at least a part of said member (40) is within said internal volume (204) of said containment portion (20).

By having this specific combination and inter-relation of features, the coating with a hair treatment composition of a hair strand, preferably of a bundle of hair strands, is achieved without messiness, avoiding excessive deposition of the hair treatment composition on the hair and in an even fashion.

The substantially flat internal surface (101) of said plate (10) of the applicator (1) according to the invention comprises an axis Y, which extends from the centre of said substantially flat internal surface (101) of said plate (10), extends substantially straight and crosses transversally said connection (30). Said member (40), preferably, comprises at least a maximum length (L); at least a maximum height (H); at least a maximum width (W); preferably said member (40) projects with said maximum height (H) from said substantially flat internal surface (101) of said plate (10) and orthogonally to said axis Y and wherein said member (40) extends along said substantially flat internal surface (101) of said plate (10) with said maximum length (L) and with said maximum width (W). More preferably, said member (40) extends along and/or substantially parallel to said axis Y.

When said hair treatment applicator (1) is in a closed state, the average distance (D1) between said perimeter (103) of said plate (10) and said rim (222) of said containment portion (20) is preferably from about 0.5 mm to about 5.0 mm, more preferably from about 0.8 mm to about 4.0 mm, even more preferably from about 1.0 mm to about 3.0 mm.

Said hair treatment applicator (1) comprises a plane (P1) on which said rim (222) of said wall (202) of said containment portion (20) lays; when said applicator (1) is in a closed state, said applicator (1) further comprises at least one segment (S1) which is formed by connecting the edge (44) of said distal base (42) of said member (40) to said rim (222); said plane (P1) and said segment (S1) form at least one angle ϕ of from about 15° to about 55°, preferably from about 20° to about 50°, even more preferably from about 25° to about 40°. This angle ϕ so defined indicates how much a hair strand, preferably a bundle of hair strands, would bend and segment (S1) measures the portion of said bent hair strand within said internal volume (204) of said containment portion (20) by said member (40) when the applicator (1) is brought from an open to a closed state.

The present invention further relates to the use of a hair treatment applicator (1) to apply a hair treatment composition to a hair strand, preferably to a bundle of hair strands, wherein said use comprises to locate said hair strand substantially straight between a plate (10), which comprises a member (40) and a containment portion (20) and then to bend said hair strand of an angle ϕ within said containment portion (20); wherein said angle ϕ is from about 15° to about 55°.

For the purpose of this invention, the term hair refers to both living hair i.e. on a living body and to non-living hair i.e. in a wig, hairpiece or other aggregation of non-living keratinous fibre. Mammalian, preferably human hair is intended.

For the purpose of this invention, the term "hair strand" means a single keratinous fibre, and the term "bundle of hair strands" means a plurality of hair strands according to the meaning given herein.

1. Hair Treatment Applicator

Said plate (10) and said containment portion (20) of said hair treatment applicator (1) according to the invention are of ergonomic size and can thus fit easily on either hand. The shape of said plate (10) may vary. Rectangular, square, circular, elliptical, oblong shape or combination thereof may be useful as they are easy to manufacture but other shapes, particularly those that are easily recognised by the consumers may also be used.

The perimeter (103) of said plate (10) and the rim (222) of said wall (202) of said containment portion (20) may curvilinear or sharp. Irrespectively from their shape, preferably said perimeter (103) of said plate (10) has substantially the same extension of said rim (222) of said containment portion (20).

Said substantially flat internal surface (101), said external surface (102) of said plate (10) as well as said bottom (201) and said wall (202) of said containment portion (20) may further comprise one or more areas, which have visible and/or tactile differences from said substantially flat internal surface (101) and/or said external surface (102) and/or from said bottom (201) and said wall (202). Said visible or tactile differences comprise differences in colour and/or shade, differences in patterns, markings and/or embossments. Those visible or tactile differences, differences in colour and/or shade, differences in patterns, markings and/or embossments, in particular those present in the containment portion (20) may be provided to indicate where and how much hair treatment composition should be loaded into the hair treatment applicator (1).

Said internal surface (101) of said plate (10) is substantially flat whilst said external surface (102) of said plate (10), said bottom (201) and said wall (202) of said containment portion (20) may be independently substantially flat or curved. Preferably, the bottom (201) of said containment portion (20) is substantially flat. Said substantially flat internal surface (101) may have a surface area of from about 2 $cm^2$ to 150 $cm^2$ preferably about 2 $cm^2$ to about 70 $cm^2$ more preferably from about 3 $cm^2$ to about 50 $cm^2$, even more preferably from about 4 $cm^2$ to about 30 $cm^2$.

Said plate (10) and/or said containment portion (20) or at least a portion thereof may comprise one or more cavities, one or more V- or U-shaped grooves or combinations thereof. Said cavities or grooves may be independently located on said substantially flat internal surface (101), on said external surface (102), on said bottom (201), on said wall (202) or combinations thereof.

Said plate (10) and said containment portion (20) may be manufactured from any known material or combination of materials capable of supporting a hair treatment composition. Suitable materials are polymer resins such as a polyolefins e.g. polypropylene, polyethylene or polyethylene terephthalate. Other materials which could be used include polyvinylchloride, polyamide, acetyl, acrylonitrile butadiene styrene, acrylic, acrylonitrile styrene acrylate, ethylene vinyl alcohol, polycarbonate, polystyrene, silicone or thermo plastic elastomer, thermo plastic vulcanate or copolymers where appropriate; flexible pliable substrates such as paper boards, metal based substrates and aluminium foils, filmic substrates or multiple laminations or combinations of multiple layers of said materials.

The method of manufacture of said plate (10) and said containment portion (20) may include, but is not limited to, injection moulding, co-injection moulding, over moulding, in-mold assembly, compression moulding, blow moulding, thermo or vacuum forming of a blister type shell and lamination onto a carrier plastic or board material in the horizontal or vertical plane.

A connection (30) movably joins said plate (10) and said containment portion (20). A connection (30) is necessary in the applicator (1) to improve the user's perception of control over the applicator (1) and to allow the user to guide the applicator (1), with the use of either hand, precisely and easily to each bundle of hair strands. In addition, the connection (30) allows the user to move the applicator (1) from one bundle of hair strands to another without having to adjust the position of said plate (10) onto said containment portion (20) after each application, so that said substantially flat internal surface (101) of said plate (10) can be brought into a consistent juxtaposed relationship to said opening (203).

Figure 3:
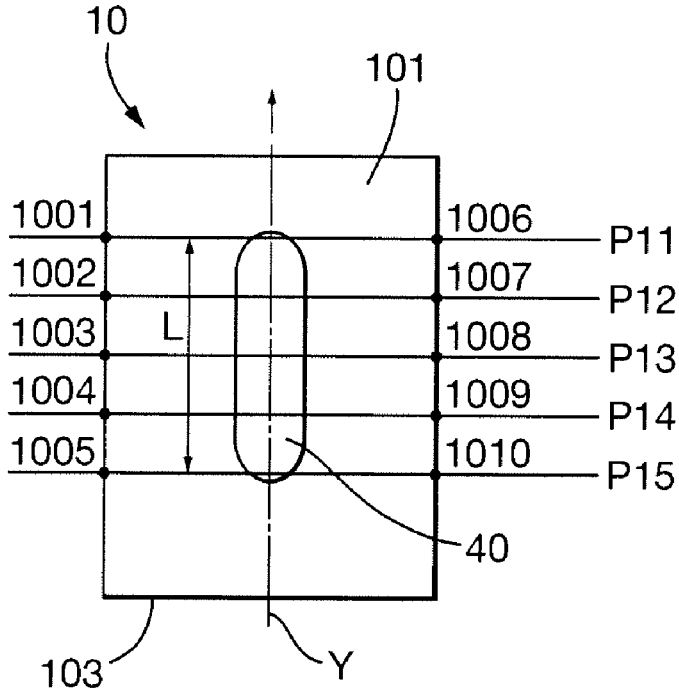
FIG. 3 is a view of the substantially flat internal surface (101) of said plate (10) according to the invention, wherein planes (P11, P12, P13, P14 and P15), perpendicular to axis Y and parallel to said substantially flat internal surface (101) equally divide the maximum length (L) of said member (40). Planes (P11 to P15) intersect said perimeter (103) of said plate (10), identifying ten positions (1001 to 1010) on said perimeter (103) of said plate (10) where to measure the average distance (D1) and angle $\phi$.
Figure 4:
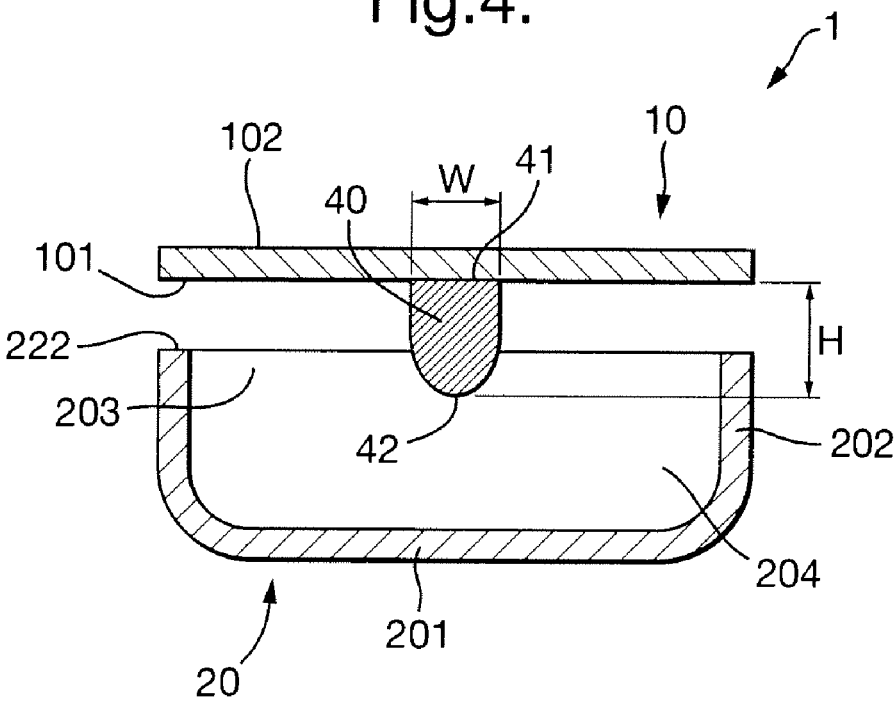
FIG. 4 is a cross-section of an embodiment of the hair treatment applicator (1) according to the present invention, said cross-section being taken along plane (P13). The hair treatment applicator (1) is shown in a closed state and the cross-section is transversal to axis Y. In this embodiment, said external surface (102) is also substantially flat. The containment portion (20) comprises a bottom (201) and a wall (202), comprising a rim (222), which defines an opening (203) of said containment portion (20) and an internal volume (204) for containing a hair treatment composition. A member (40), which has a proximal base (41) and a distal base (42), comprises a maximum height (H) and a maximum width (W) and said member (40) projects from the substantially flat internal surface (101) of said plate (10).

A connection (30) between said plate (10) and said containment portion (20) according to the present invention allows the hair treatment applicator (1) to alternate from an open state to a closed state. When the hair treatment applicator (1) is in an open state, as shown in FIG. 1, the angle between said substantially flat internal surface (101) of said plate (10) and the rim (222) of said wall (202) of said containment portion (20) may range between 20° and 275°, preferably between 30° and 190°, more preferably between 40° and 90°. When the hair treatment applicator (1) is in a closed state, as shown in FIG. 4, said substantially flat internal surface (101) of said plate (10) is in a juxtaposed relationship to said opening (203) of said containment portion (20) and at least a part of said member (40) is within said internal volume (204) of said containment portion (20). Said substantially flat internal surface (101) of said plate (10) has an average distance (D1) from said rim (222) of said wall (202) as shown in the bottom portion of FIG. 5. Said average distance (D1) is preferably from about 0.5 mm to about 5.0 mm, more preferably from about 0.8 mm to about 4.0 mm, even more preferably from about 1.0 mm to about 3.0 mm. The average distance (D1) was determined using Mitutoyo Digimatic callipers as described hereafter. When said applicator (1) is in a closed state and said substantially flat internal surface (101) of said plate (10) is in a juxtaposed relationship to said opening (203) of said containment portion (20) a Mitutoyo Digimatic callipers was positioned at the perimeter (103) of said plate (10) and the distance from said rim (222) was measured. This step was repeated for ten different positions. These ten different positions on said perimeter (103) of said plate (10) were the points 1001 to 1010 on five planes (P11 to P15) as shown in FIG. 3. Planes (P11 to P15) were perpendicular to axis Y and parallel to said substantially flat internal surface (101) of said plate (10). Those five planes (P11 to P15) equally divided said maximum length (L) of said member (40).

The closed state is the state whereby when a hair strand, preferably a bundle of hair strands is positioned substantially straight between said plate (10), which comprises a member (40) and said containment portion (20), said hair strand or bundle of hair strands is bent into the internal volume (204) of said containment portion (20) by said member (40) of said plate (10) as shown in FIG. 5.

Said plate (10) and said containment portion (20) may pivot about said connection (30) to alternate from an open state to a closed state; in one embodiment, the hair treatment applicator (1) is in an open state and the user applies pressure on the external surface (102) of said plate (10) and on said bottom (201) of said containment portion (20) to bring the hair treatment applicator (1) in a closed state. To move said plate (10) and said containment portion (20) back from a close state to a open state either said external surface (102) of said plate (10) and said base (201) of said containment portion (20) may be independently provided with one or more fitting means for the user's fingers or the connection (30) itself may re-establish the initial orientation of said plate (10) and said containment portion (20), preferably by springing back. The spring back property should preferably not occur uncontrollably and unexpectedly as it may otherwise injure the user's hand and fingers. Uncontrolled spring back may displace inadvertently the hair treatment composition from the hair treatment applicator (1) causing messiness. The connection (30) should work preferably with applicable pressures suitable for use by most consumers.

The characteristics of said connection (30) may be an intrinsic property of the material used to manufacture said connection (30) or may be provided by the design of the connection (30) itself. The connection (30) should preferably not break or get damaged so as to affect utility within a few applications. The connection (30) should preferably not be too resistant to the applied pressure by the user, otherwise the user's hand and fingers may ache during repetitive use. The connection (30) should also not be too weak or provide little or no perception of guidance over the hair treatment applicator (1).

The plate (10) and the containment portion (20) are connected via any suitable means that fulfils the above described requirements for the connection (30), including the user's hand, for example through the thumb and index finger. In one embodiment, said plate (10) and said containment portion (20) are connected via one or more hinges, preferably one hinge. More preferably, said connection comprises a fulcrum (35) as shown in FIG. 1. Said fulcrum (35) is preferably located adjacently to said perimeter (103) of said plate (10) and to said rim (222) of said containment portion (20). Said one or more hinges can be formed in a number of ways including: a "live" injection moulded hinge, a co-injected hinge, an over moulded hinge, in-mold assembly, a leaf spring or any other appropriate spring assembly, a strap hinge, a fold formed by a kiss-cut, score or crease.

In certain embodiments both said plate (10) and said containment portion (20) have a female part of the hinge incorporated in their design. The female part of the hinge is created during the manufacture process for said plate (10) and for said containment portion (20), for example during the injection moulding process. A pin is designed to fit both female parts of the hinge created on said plate (10) and said containment portion (20). The pin, preferably of rectangular shape, is manufactured from a polymer resin such as polyolefin, preferably polypropylene. The pin is assembled into the female parts of said plate (10) and said containment portion (20) to create the hinge.

In certain embodiments, both said plate (10) and said containment portion (20) may be manufactured within the same injection mould for example from polypropylene. A living hinge also made from polypropylene may be created between said plate (10) and said containment portion (20). Polypropylene may be used to provide a living hinge that can be flexed multiple times without breakage. The living hinge is typically closed during the de-moulding process.

In certain embodiments, both said plate (10) and said containment portion (20) may be manufactured within the same injection mould for example from polypropylene and a hinge can be created by co-injection, in-mold assembly or overmoulding of a thermo plastic elastomer or a thermo plastic vulcanate or any other material that can be used to provide a hinge with the properties listed above.

2. Member

Said plate (10) according to the hair treatment applicator (1) of the present invention comprises at least one member (40). Said at least one member (40) is continuous, liquid impervious and projects from said substantially flat internal surface (101) of said plate (10). For the purpose of this invention, the term "continuous" means that the member (40) is not composed of distinct and independent units arranged to simulate a member (40). Thus, within the present invention, an arrangement of teeth, tines, bristles and combination thereof does not constitute a member (40). In addition, for the purpose of this invention, the term "liquid impervious" means that the member (40) is impermeable to water, organic solvents and complex formulations such as those which are defined herein below as hair treatment compositions.

Without wishing to be bound by theory, it is believed that an arrangement of independent units not close enough to create a continuous member (40), may result in the hair treatment composition to be sequestered within the interstices between those units. Similarly, a member (40), which may absorb a hair treatment composition or a phase thereof, may sequester it. Once sequestered the hair treatment composition may not be visible to the user, so the latter may be wrongly induced to prematurely reload the hair treatment applicator (1), which would result in messiness.

As shown in FIG. 4, said member (40) comprises a proximal base (41) and a distal (42) base. Said proximal base (41) is attached to said substantially flat internal surface (101). Said distal base (42) comprises an edge (44) and preferably said edge (44) is curvilinear.

Figure 2A:
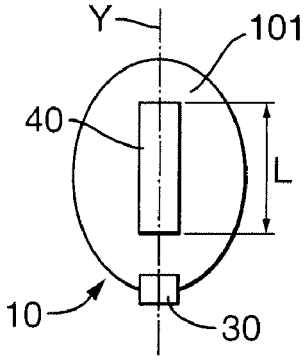
FIGS. 2A, 2B and 2C are views of different embodiments according to the invention, wherein each view shows said substantially flat internal surface (101) of said plate (10) of said hair treatment applicator (1). Axis Y extends from the centre of said substantially flat internal surface of said plate (10) and crosses transversally said connection (30) preferably perpendicular.
Figure 2B:
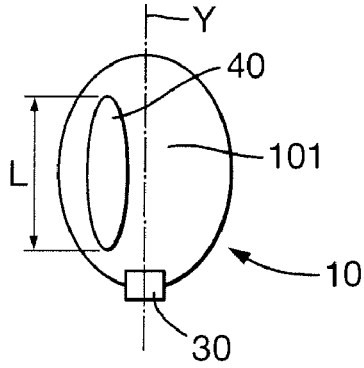
Figure 2C:
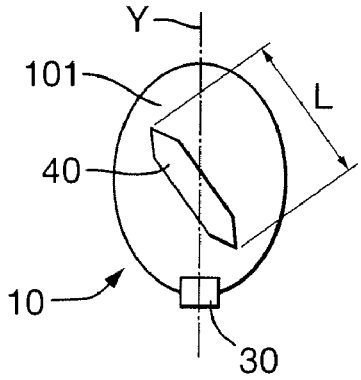

Said substantially flat internal surface (101) of said plate (10) of said hair treatment applicator (1) according to the present invention comprises an axis Y. Said axis Y extends substantially straight from the centre of said substantially flat internal surface (101) of said plate (10) and crosses transversally said connection (30) as shown in FIGS. 2A, 2B and 2C.

Said member (40) has at least a maximum height (H); at least a maximum width (W) and at least a maximum length (L). Said member (40), preferably, projects with a maximum height (H) from said substantially flat internal surface (101) of said plate (10) and orthogonally to said axis Y. Said member (40) extends preferably along said substantially flat internal surface (101) of said plate (10) with a maximum length (L) and a maximum width (W) as shown in FIGS. 2A, 2B, and 2C. Said member (40) may extend with its maximum length (L) along said axis Y as shown in FIG. 2A or as shown in FIG. 2B its maximum length (L) may be substantially parallel to said axis Y. The maximum length (L) of said member (40) may extend transversally to said axis Y but also intermediate positions, one of which is shown in FIG. 2C, are also contemplated within the scope of the present invention. Said member (40) preferably extends along and/or substantially parallel to said axis Y.

Preferably, said maximum length (L) is at least twice said maximum width (W). The maximum length (L) is preferably from about 20.0 cm to about 0.2 cm, more preferably from about 15.0 cm to about 0.3 cm, even more preferably from about 10.0 cm to about 0.5 cm. The maximum width (W) is preferably from about 2.5 cm to about 0.01 cm, more preferably from about 1.0 cm to about 0.02 cm, even more preferably from about 0.5 cm to about 0.03 cm. The maximum height (H) is preferably from about 5.0 cm to about 0.1 cm, more preferably from about 2.5 cm to about 0.2 cm, even more preferably from about 1.5 cm to about 0.3 cm.

The member (40) may have various forms including, but not limited to, a parallelepiped form, a cube form, a cylinder form, a conical or a pyramidal frustum form. In an embodiment of the present invention shown in FIG. 1, said member (40) has preferably a substantially pyramidal frustum form.

In another embodiment not show herein, said member (40) comprises a cylinder which is rotary engaged via its circular bases to said substantially flat internal surface (101) via two pins, emerging from said substantially flat internal surface (101) of said plate (10).

When said hair treatment applicator (1) is in a closed state, said distal base (42) of said member (40) does not contact said bottom (201) of said containment portion (20), so that a passage is left and said hair strand, preferably said bundle of hair strands, is not constrained.

The member (40) may be manufactured dependently or independently of the hair treatment applicator (1) from any known material or combination of materials capable of supporting a hair treatment composition and from any material which is liquid impervious. Suitable materials are polymer resins such as a polyolefin e.g. polypropylene, polyethylene or polyethylene terephthalate. Other materials which could be used include polyvinylchloride, polyamide, acetyl, acrylonitrile butadiene styrene, acrylic, acrylonitrile styrene acrylate, ethylene vinyl alcohol, polycarbonate, polystyrene, silicone or thermo plastic elastomer, thermo plastic vulcanate or copolymers where appropriate; flexible pliable materials such as metal based substrates and aluminium foils, filmic substrates or multiple laminations or combinations of multiple layers of said materials.

The method of manufacture of the member (40) may include, but is not limited to, injection moulding, co-injection moulding, over moulding, in-mold assembly, compression molding, blow moulding, thermo or vacuum forming.

When the member (40) is independently manufactured from the hair treatment applicator (1), the member (40) may be attached by any suitable method to the internal surface (101) of said plates (10). Useful methods are, but not limited to, heat welding including pressure, ultrasonic forces, radio or high frequencies, co-extruded heat activated adhesives. The member (40) may also be attached to the hair treatment applicator (1) through adhesive, including two-side tape, thermoset, hot melt and cold seal, adhesion or extrusion lamination. Mechanical interlock or entanglement such as Velcro@, clamping, snap locks, sealing beads, locking pins and magnetism may also be used to adhere the member (40) to the hair treatment applicator (1).

3. Experimental Data

The present inventors have surprisingly found that to satisfactorily apply a hair treatment composition to a hair strand, preferably to a bundle of hair strands, said hair strand needs firstly to come into contact with the hair treatment composition comprised within the applicator (1), secondly said hair treatment composition having just come into contact with said hair strand should be applied onto said hair strand and thirdly while using said applicator (1) along the entire length of said hair strand, the just applied hair treatment composition should not be removed from said hair strand.

Without wishing to be bound by theory, it is believed that to apply a hair treatment composition to a hair strand, preferably to a bundle of hair strands, said hair strand is located substantially straight between a plate (10), which comprises a member (40) and a containment portion (20) of a hair treatment applicator (1) and then said hair strand is bent by said member (40) to an angle $\phi$ into said containment portion (20), where the hair treatment composition has been previously loaded. Angle $\phi$, which expresses the bending of said hair strand within said containment portion (20), is described hereafter and shown in FIGS. 5A, 5B and 5C. Said hair treatment applicator (1) comprises a plane (P1) on which said rim (222) of said wall (202) lays, as shown in the top portion of FIG. 5B; a hair strand is positioned substantially straight between said plate (10) and said containment portion (20), while the applicator (1) is in an open state and said applicator (1) is then brought into a closed state as shown in FIG. 5C. Said hair strand is bent by said member (40) to an angle $\psi$ within said internal volume (204) of said containment portion (20). Said angle $\phi$ is thus defined by said plane (P1) and by a segment (S1) which is the portion of said hair strand, preferably of said bundle of hair strands, which is within said internal volume (204), between said rim (222) and said edge (44) of said member (40).

The present inventors have surprisingly found that to achieve a successful application of a hair treatment composition to a hair strand, preferably to a bundle of hair strands, angle $\psi$ should range from about 15° to about 55°, preferably from about 20° to about 50°, more preferably from about 25° to about 40°. To demonstrate that a hair treatment applicator (1) as described herein may provide for an application of a hair treatment composition to a hair strand, preferably to a bundle of hair strands, the present inventors have correlated how the average on-hair dosage and the average evenness change by changing angle $\phi$ as described above.

Figure 5A:
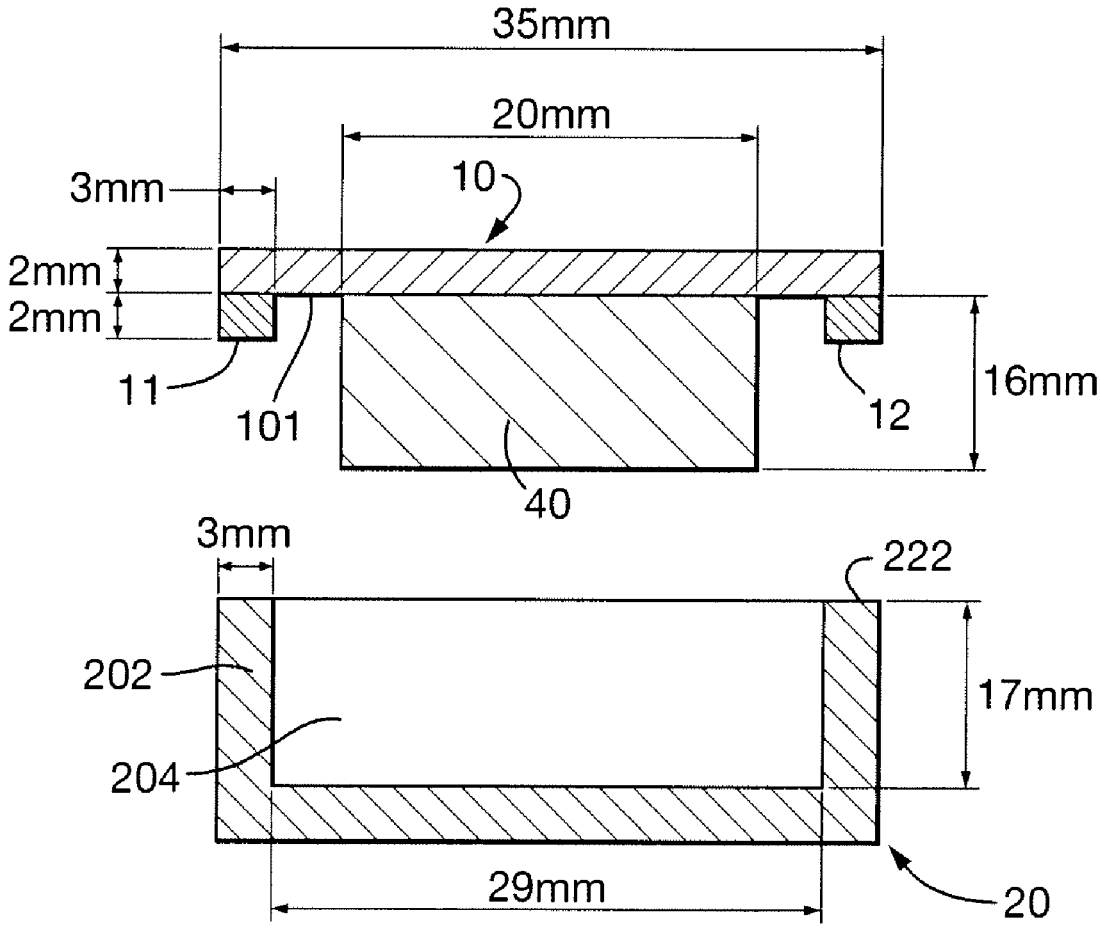
FIG. 5A is a cross-section of an embodiment of the treatment applicator (1) according to the invention, said cross-section being taken along axis Y. The applicator (1) is shown in an open state. The plate (10) comprises a member (40) and two strips (11; 12) to define the average distance (D1).
Figure 5B:
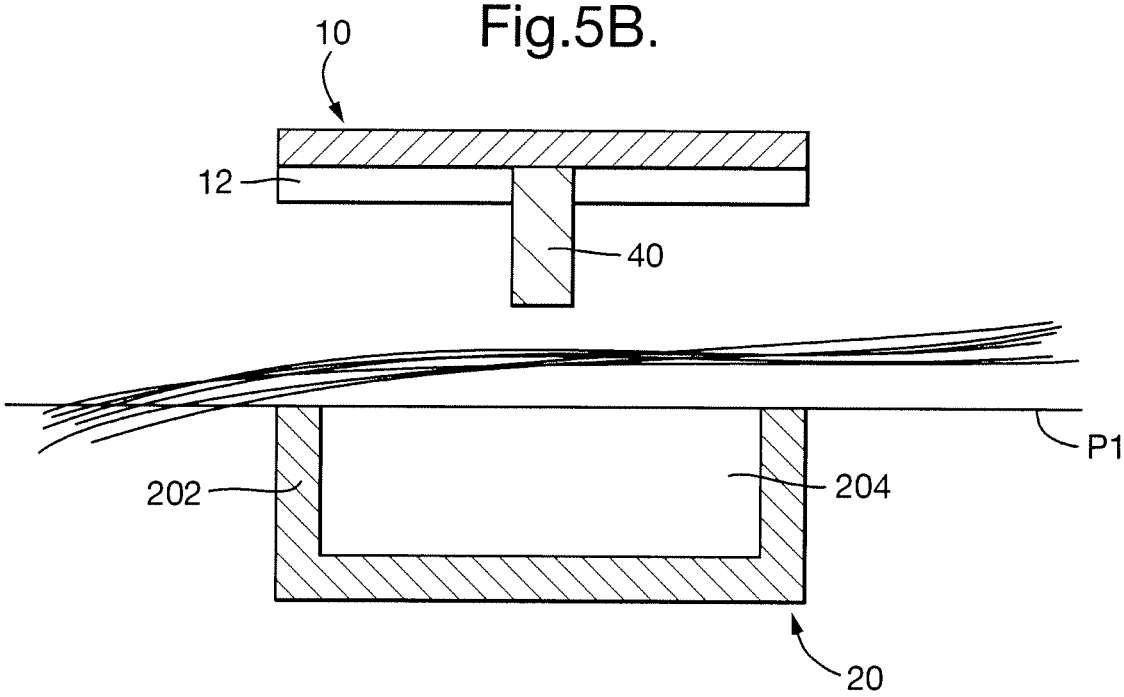
FIG. 5B shows the same applicator (1) of 5A, but this cross-section has been taken along plane P13. The applicator (1) is in a open state. A bundle of hair strands is located substantially straight between said containment portion (20) on a plane (P1) which is the plane with the rim (222) and the wall (202) lays and said plate (10), which comprises a member (40).
Figure 5C:
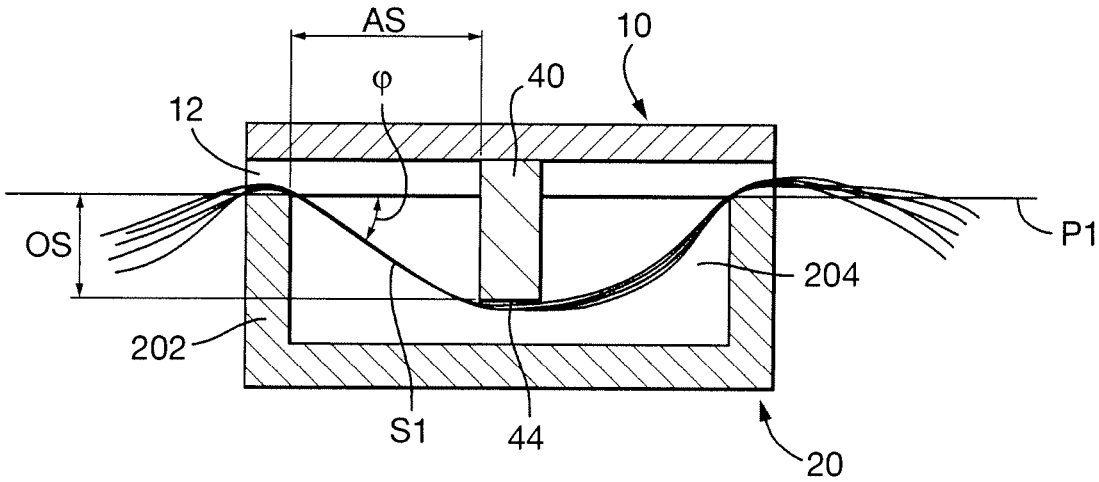
FIG. 5C shows the same applicator (1) of FIG. 5A, but this cross-section has been taken along plane P13. The applicator (1) is in a closed state so that the average distance (D1) between the substantially flat internal surface (101) of the plate (10) and the rim (222) of the wall (202) of the containment portion (20) is as claimed herein and as defined by the thickness of said strips (12), said bundle of hair strands is bent to an angle $\phi$ within the containment portion (20). Segment (S1) is the portion of said bundle of hair strands bent within the internal volume (204) between the rim (222) of the wall (202) and said distal edge (44) of said member (40). Angle $\phi$ is the angle formed between said plane (P1) and segment (S1). Angle $\phi$ is the trigonometric relationship cotangent of the ratio of the opposite segment (OS) to the adjacent segment (AS).

A square plate (10) was manufactured in acrylic, said plate (10) having dimensions of about 35 mm in length and width and about 2 mm in thickness as shown in FIG. 5A. One strip (11) of acrylic having dimensions of about 35 mm in length, about 3 mm in width and about 2 mm in thickness was placed along one edge on a surface of said square plate (10). Said surface of said square plate (10) was then the substantially flat internal surface (101) of said square plate (10). Another identical strip (12) was placed along the edge opposite said edge were the first strip of acrylic was placed. The two acrylic strips functioning as stop mechanism provided said average distance (D1) of said substantially flat internal surface (101) of said plate (10) as described above. Axis Y extends substantially straight from the centre of said substantially flat internal surface of said square plate (10) and crosses transversally both acrylic strips. A member (40) was moulded together with the top plate and also manufactured in acrylic. Said member (40) has dimensions such as to provide the heights shown in table 2A and 2B. Said member (40) was located centrally on said substantially flat internal surface (101) of said square plate (10) and said member (40) extends along said axis Y. A square containment portion (20) was made from acrylic. The bottom (201) and the wall (202) defined an internal volume (204) having an internal dimension of about 29 mm in length and width and about 17 mm in height. Said rim (222) of said wall (202) was of about 3 mm in width. The square plate (10) and the square containment portion (20) were kept apart and the square containment portion (20) was loaded with about 3.5 grams of Carbopol™ 956 solution (available from Noveon) prepared according to table 1 below. The viscosity of the Carbopol™ 956 solution was determined on a Brookfield DV-II+viscometer with a S52 cone attachment. A sample of 0.5 ml of the Carbopol™ 956 solution was equilibrated at approximately 26.7° C. and 1 rpm for one minute prior to measurement, whereupon the average of three individual readings were taken at 1 rpm.

TABLE 1

Carbopol ™ 956 solution for measuring average on-hair dosage and average evenness

| Ingredients | % w/w |
|---|---|
| De-ionized Water | q.s. to 100 |
| Carbopol ™ 956 | 0.35 |
| Sodium Hydroxide (50% aq. Solution) | 0.27 |
| Ultramarine Blue pigment | 0.05 |
| Titanium dioxide | 0.41 |
| Average Viscosity | 35,300 cPs |

A 0.30 grams bundle of hair strands, about 30.5 cm long (Caucasian Light Brown—International Hair Imports and Products, Valhalla, N.Y.) was placed on the rim (222) of said square containment portion (20), so that when said substantially flat internal surface (101) of said square plate (10) is brought into a juxtaposed relationship to the opening of said square containment portion (20) said bundle of hair strand is perpendicular to the member (40) and parallel to the strips acting as a stop mechanism. The square plate (10) and containment portion (20) were brought into a juxtaposed relationship until the strips acting as stop mechanism touched the rim (222) of the square containment portion (20). As the substantially flat internal surface (101) of said plate (10) has the same extension of said opening (203) and rim (222) of said containment portion (20), the plate is laid upon the containment portion so that it completely and precisely covers the opening (203) and the rim (222). The bundle of hair strands is bent to an angle $\phi$. While keeping the square plate (10) and the square containment portion (20) on the bundle of hair strands, the entire length of the bundle of hair strands was swiped taking about 3 seconds for the swipe. The weight of the bundle of hair strands was recorded. The same experiment was repeated three times, the results averaged and indicated in FIG. 6 and table 2 as grams of pigmented Carbopol™ 956 solution deposited per gram of hair.

Angle $\phi$ was trigonometrically calculated according to formula (I)

$$\text{Angle } \varphi = \tan^{-1}\left(\frac{OS}{AS}\right) \tag{I}$$

Wherein OS is the opposite segment to angle $\phi$ and wherein AS is the adjacent segment to angle $\phi$. In this specific embodiment shown in FIG. 5, OS is about 14 mm and AS is about 13 mm, thus, according to formula (I), angle $\phi$ is about 47.1°.

It should be understood that other means may be used either to calculate or to measure angle $\phi$, such as CAD software or a protractor.

The maximum height (H) of said member (40) was reduced by about 1 mm to maintain a constant distance of said distal base (42) of said member (40) to said bottom (201) of said containment portion (20) a square plate of about 29 mm in length and width and about 1 mm in height was placed on the bottom (201) in the containment portion (20). The same experiment was been repeated three times for each maximum height (H) of said member (40) from about 18 mm to about 3 mm. These data are shown in table 2a herein below:

TABLE 2a

Figure 6:
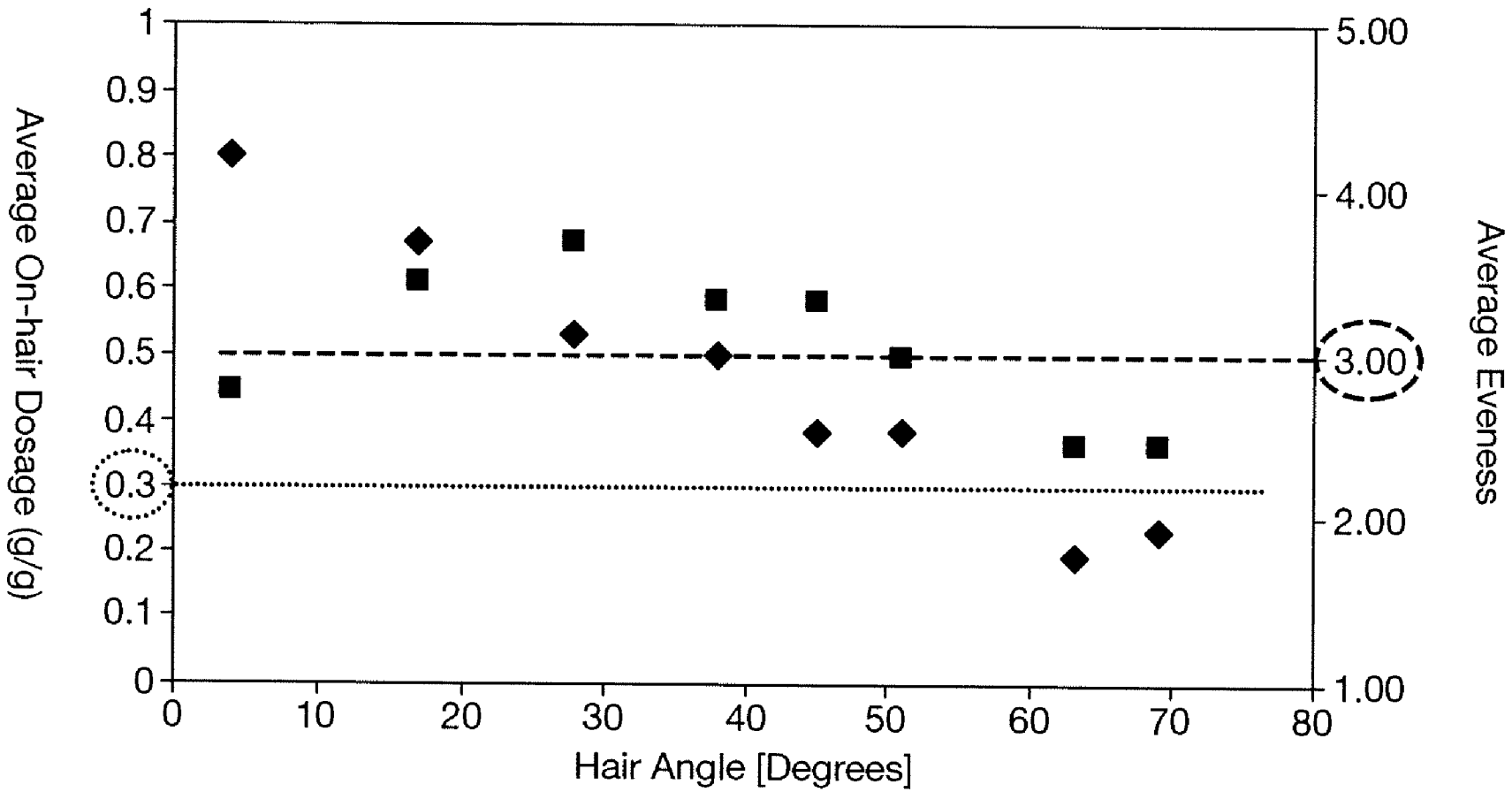
FIG. 6 shows for an embodiment of the hair treatment applicator (1) according to the invention how the average on hair dosage (◆) and the average evenness (■) change by altering angle $\phi$ when a pigmented Carbopol™ 956 solution is applied to a bundle of hair strands.

Average on-hair dosage, average evenness data and relative angle ϕ as shown in FIG. 6.

| Maximum height of member (40) [mm] | Angle ϕ [Degrees] | Average on-hair dosage [g/g] | Average Evenness |
|---|---|---|---|
| 18 | 51 | 0.38 | 3.00 |
| 15 | 45 | 0.38 | 3.33 |
| 12 | 38 | 0.50 | 3.33 |
| 9 | 28 | 0.53 | 3.67 |
| 6 | 17 | 0.67 | 3.44 |
| 3 | 4 | 0.80 | 2.78 |

A second plate (10) rectangular in shape was manufactured according to the dimensions above with the exception that the length of said plate (10) and identical strips (11 and 12) was about 29 mm. A second containment portion (20) rectangular in shape was also produced according to the internal dimensions above with the exception that the length of said plate (10) was about 23 mm. The said second plate (10) and said second containment portion (20) were aligned such that the 29 mm length of said second plate (10) was aligned with the 29 mm length of said second containment portion (20) and kept apart. The second containment portion (20) was loaded with about 1.58 grams of Carbopol™ 956 solution (available from Noveon) prepared according to table 1 below. The same experiment was repeated with said second plate (10) and said second containment portion (20) as described above. Data are shown in table 2b below and are plotted in FIG. 6.

TABLE 2b

Average on-hair dosage, average evenness data and relative angle ϕ as shown in FIG. 6.

| Maximum height of member (40) [mm] | Angle ϕ [Degrees] | Average on-hair dosage [g/g] | Average Evenness |
|---|---|---|---|
| 15 | 69 | 0.23 | 2.44 |
| 12 | 63 | 0.25 | 2.44 |
| 8 | 50 | 0.40 | 3.33 |
| 6 | 39 | 0.46 | 3.67 |

The evenness of the application was visually assessed for root-to-tip (along length of hair bundle); center-to-edge (across hair bundle width) and front-to-back (both sides of hair bundle) using a 1 to 5 rating scale (1 being poor evenness). These ratings were combined to provide an average evenness, which is shown in table 2.

FIG. 6 shows the average on-hair dosage in grams of pigmented Carbopol™ 956 solution deposited per gram of hair (shown with the symbol ♦) and the average evenness (shown with the symbol ■) as a function of angle ψ. A successful hair treatment application has been defined from the present inventors to be the combination of an average evenness of at least about 3 and an average on-hair dosage of at least about 0.3 grams of pigmented Carbopol™ 956 solution per gram of hair.

When angle ϕ is less than about 15°, although the average on-hair dosage is above about 0.3 grams of pigmented Carbopol™ 956 solution per gram of hair, the average evenness is below about 3. Thus, if the bundle of hair strands is bent of less than about 15° within the containment portion (20), the application of a hair treatment composition to a bundle of hair strands is poor and not satisfactory.

When angle ϕ is from about 15° to about 55°, the application of the pigmented Carbopol™ 956 solution to a bundle of hair strands is satisfactory as both the average on-hair dosage and the average evenness are above the limits defined herein, thus, providing for the best combination.

For angles ϕ more than about 55°, the average evenness and the average on-hair dosage were both below the required targets, so the application was not satisfactory.

The same experiment was repeated with the same applicator (1) as shown in FIG. 5, with the same type of hair and with the same method for a highlighting composition instead of the pigmented Carbopol™ 956 solution. The highlighting composition was prepared according to Table 3 below:

TABLE 3

Highlighting composition

| | % |
|---|---|
| Developer | |
| Deionized Water | 72.35 |
| Hydrogen Peroxide 50% | 18.0 |
| Cetearyl Alcohol (and) Ceteareth-20 | 1.5 |
| Glyceryl Stearate | 4.0 |
| Oleth-10 | 0.3 |
| Oleth-2 | 0.3 |
| Stearamidopropyl Dimethylamine | 0.6 |
| Etidronic Acid | 0.25 |
| Persulfate Powder | |
| Potassium Persulfate (+silica) | 45.0 |
| Ammonium Persulfate (+silica) | 10.0 |
| Sodium Silicate | 39.5 |
| Disodium EDTA | 1.0 |
| TiO2 | 3.5 |
| UM Blue | 1.0 |

The highlighting composition was prepared by mixing about 9.71 grams of persulfate powder with about 35.00 grams of developer in a bottle of about 100 ml. Mixing was performed by hand-shaking the bottle for about 30 seconds.

Data are shown in table 4 below and are plotted in FIG. 7.

TABLE 4

Figure 7:
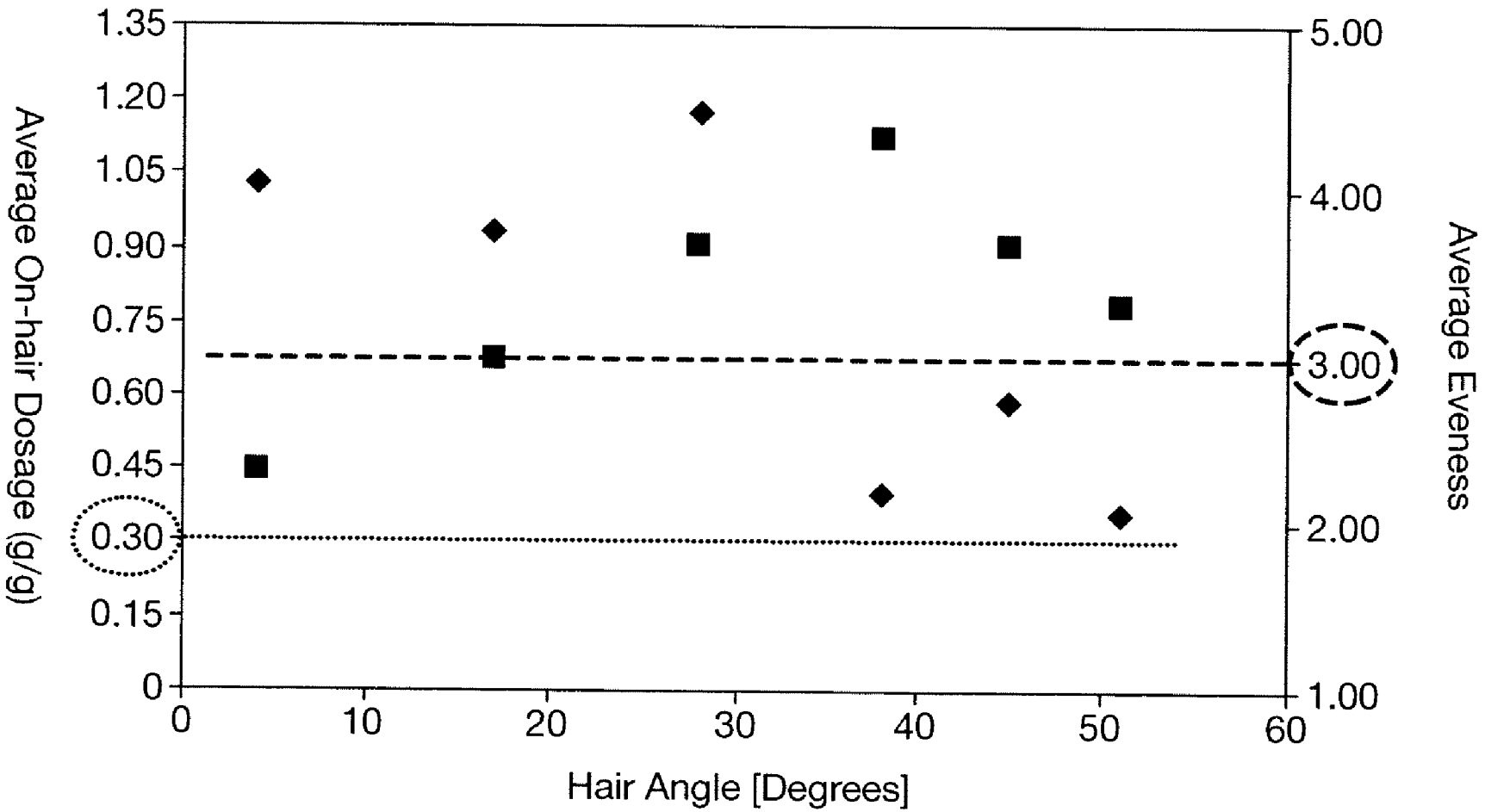
FIG. 7 shows for an embodiment of the hair treatment applicator (1) according to the invention how the average on hair dosage (♦) and the average evenness (■) change by altering angle ϕ when a highlighting composition is applied to a bundle of hair strands.

Average on-hair dosage, average evenness data and relative angle ϕ as shown in FIG. 7.

| Maximum height of member (40) [mm] | Angle ϕ [Degrees] | Average on-hair dosage [g/g] | Average Evenness |
|---|---|---|---|
| 18 | 51 | 0.36 | 3.33 |
| 15 | 45 | 0.59 | 3.67 |
| 12 | 38 | 0.40 | 4.33 |
| 9 | 28 | 1.17 | 3.67 |
| 6 | 17 | 0.93 | 3.00 |
| 3 | 4 | 1.03 | 2.33 |

The highlighting product was left on the said bundle of hair strands for about 30 minutes at about 30° C. and rinsed with water for one minute and air dried for 24 hours. Those said bundles of hair strands treated with applicators that provided an angle between 51 and 17 degrees showed good, even hair lightening. The said bundle of hair strand treated with the 4 degrees applicator did not provide good, even high lightening.

FIG. 7 shows a similar trend for the average on-hair dosage and the average evenness as for the pigmented Carbopol™ 956 solution. When the angle $\phi$ is less than about 15°, although the average on-hair dosage is largely above about 0.3 grams of highlighting composition per gram of hair, the average evenness is below about 3. Thus, according to the present invention's standards, the application is poor and not successful. For angles $\phi$ of from about 15° and above till about 55° as already shown for the pigmented Carbopol™ 956 solution, the application of the highlighting composition is considered to be satisfactory.

To summarize, firstly angle $\phi$ as defined herein correlates with the average on-hair dosage and the average evenness, secondly only a specific range of angle $\phi$ values provide for a satisfactory result and thirdly said range of angle $\phi$ values are independent on the type of hair treatment composition applied.

4. Additional Features

The applicator (1) may further comprise one or more sealing means, preferably one sealing means (401) is present within the hair treatment applicator (1). Said sealing means (401) may be located within said containment portion (20) on said bottom (201) at the wall (222) adjacent to said connection as shown in FIG. 1. Said sealing means (401) may be located on said rim (222) of said wall (202) adjacent to said connection (30) or on said substantially flat internal surface (101) adjacent to said connection (30). Preferably said sealing means (401) is part of said connection (30).

The sealing means (401) is provided to avoid displacement of hair treatment composition towards the connection (30) and hair from being trapped within said connection (30) when said substantially flat internal surface (101) of said plate (10) is brought into ajuxtaposed relationship to said opening (203) of said containment portion (20). By having a sealing means (401) in the containment portion (20) on the bottom (201) at said wall (202) adjacent to said connection (30), when the plate (10) is moved toward the containment portion (20) by pivoting about the connection (30) the hair treatment composition may be displaced toward the connection (30) itself. An additional advantage related to certain embodiments of said sealing means is that it comprises a visual aid to help the user to understand where and how much hair treatment composition should be loaded within the internal volume (204) of said containment portion (20) The sealing means (401) acts as a barrier for the hair treatment composition, which is instead forced to stay within said containment portion (20) where it will be available for coating the bundle of hair strands avoiding messiness.

Useful materials to manufacture a sealing means (401) may be selected from those detailed herein above to manufacture said plate (10). Other materials which could be used include polyurethane and polyolefin foams, non-wovens, felts, where appropriate; flexible pliable substrates such as paper boards, metal based substrates and aluminium foils, filmic substrates or multiple laminations or combinations of multiple layers of said materials. The said sealing means (401) may be manufactured by a combination of the materials described above.

One or more stop mechanisms may be incorporated onto said hair treatment applicator (1). The stop mechanism collaborates with said connection (30) to ensure that when said substantially flat internal surface (101) of said plate (10) is brought into a juxtaposed relationship to said opening (203) of said containment portion (20), the average distance (D1) between the substantially flat internal surface (101) and said rim (222) is controlled. One or more stop mechanism may reduce forcing hair treatment composition beyond said rim (222) of said containment portion (20). Furthermore, it may advantageously help to maintain angle $\psi$ between plane (P1) and segment (S1) as described herein.

In certain embodiments, the stop mechanism may be manufactured during the same manufacturing step as said plate (10), said containment portion (20) and said connection (30) with the same or different material. In certain embodiments the stop mechanism may be one or more tines, teeth of a comb-like structure. In one embodiment as shown in FIG. 1, two stop mechanisms are comprised on said rim (222) of said wall (201) of said containment portion (20), preferably said two stoppers are two substantially identical hemispheres (402; 403). In certain other embodiments, not shown herein, the stop mechanism may be integrated within connection (30) itself.

Useful materials to manufacture a stop mechanism (402) may be selected, where appropriate, from those detailed herein above to manufacture said plate (10) and combinations thereof.

Fingers may be used to select the hair strands on which the hair treatment composition should be applied. The applicator (1) of the present invention may however be further provided with hair strand selection means. Examples of hair strand selection means are, but not limited to, spikes, hooks, crochets, clips or beads. The hair strand selection means may be incorporated onto said plate (10) and/or said containment portion (20). Said means may also be attached through a snap mechanism to said plate (10) and/or said containment portion (20) such that the hair strand selection means may swing from a position proximal to said plate (10) and/or said containment portion (20) to a far one, such as happens with the blades of a penknife. The hair strand selection means may also be separately provided to the applicator (1) of the present invention as a component of a kit as described herein below.

The applicator (1) disclosed herein may further comprise gripping areas on the external surfaces (102) of said plate (10) and/or on said base (201) of said containment portion (20). Said gripping areas are designed to provide grip. These gripping areas may be manufactured using co-injection or overmoulding techniques when the hair treatment applicator is manufactured. Useful materials include, but are not limited to, those materials detailed herein above for the manufacture of said sealing means (401) and combinations thereof.

In addition, the gripping areas may be formed through embossing, debossing or coating of the external surfaces (102) of said plate (10) and/or of said base (201) of said containment portion (20). Gripping means may be cavities present on the external surface (102) of said plate (10) and/or on said base (201) of said containment portion (20). Finally, the gripping means may be provided as fastening means to accommodate the user's fingers.

To protect said substantially flat internal surface (101) of said plate (10) and/or the opening (203) of said containment portion (20) release liners or barriers may be present. The release liner or barrier may be peelable or resealable and may be constructed from a plastic, aluminium laminate constructions. Some examples of these materials include: laminates of low density polyethylene or blends of polyethylene with poly-isobutylene with aluminium foil and polyethylene terephthalate or bi-orientated polypropylene peel-able foils and may be made of a gas resistant material, especially for hair treatment composition comprising hydrogen peroxide, including aluminium laminated foil, metalised aluminium onto a plastic carrier, Aclar® polychloro-trifluoroethylene, polyvinylidene chloride, ethylene-vinyl alcohol copolymer, silica and aluminium oxides.

One or more means suitable to attach, adapt or install a dispensing or loading device to perform the loading of the hair treatment composition into the applicator (1) according to the invention may be present. Examples of said means are, but not limited to, nozzles and orifices, pouch pocket or one-way or two-way valves present on said plate (10) and/or said base (201) and/or wall (202) of said containment portion (20). Said means may be permanently connected to the applicator (1) or may be removable, they may be disposable or recyclable and they may be provided as a separate component of a kit as described herein below.

4. Method of Use

The present invention also relates to a method to treat the hair by contacting a hair strand, preferably a bundle of hair strands, with the hair treatment applicator (1) according to the invention. Said hair treatment applicator (1) may be preloaded with one or more hair treatment compositions, but preferably one or more hair treatment compositions are loaded into said hair treatment applicator (1) before the contact of said hair strand, preferably said bundle of hair strands, with said applicator (1).

The hair treatment composition can be loaded onto the hair treatment applicator (1) by any means. In one embodiment the hair treatment composition is loaded directly into said internal volume (204) of said containment portion (20) by applying the hair treatment composition for example with a spatula or a syringe, by a squeezable tube, by a dispensing bottle, by a single or dual phase pump, by a single or dual phase piston causing volumetric displacement, by a sachet or by any other suitable dispenser. When an optional means to perform the loading of the hair treatment composition into the hair treatment applicator (1) as described above is present, the hair treatment composition may be loaded into said containment portion (20) through a one-way or two-way valve present in said means and/or in said wall (202) or bottom (201) of said containment portion (20).

The hair treatment compositions may be a single hair treatment composition or may be formed by a first hair treatment composition which requires mixing with a second hair treatment composition before application to the hair. Preferably, said first and second hair treatment compositions are mixed to form a third hair treatment composition. Said third hair treatment composition is loaded in said hair treatment applicator (1) before contacting the hair strand, preferably a bundle of hair strands, with said hair treatment applicator (1). Said first and second hair treatment composition may be mixed by shaking or stirring before loading into said hair treatment applicator (1) or may be mixed during the loading procedure by employing specialized two or multi-chambered containers coupled with a static mixer. The mixing may also be performed by interposing an additional means capable of mixing two or more hair treatment compositions or capable of mixing powders with water or other solvents to make a hair treatment composition. Said interposed means can also be provided with features to inject or load the mixed hair treatment compositions into the hair treatment applicator (1).

Multiple or subsequent loading may be accomplished by positioning, the hair treatment applicator (1) in a tray or by connecting or attaching the hair treatment applicator (1) to multi-chambered bottles, tubes or other applicators capable of dispensing either the single or the total amount of the hair treatment composition needed. When a tray is used, said tray comprises at least one compartment where the hair treatment applicators (1) are positioned or adapted. The tray may further comprise one or more compartments where the hair treatments compositions are loaded and/or stored and which are in communication with the hair treatment applicator (1).

The amount of hair treatment composition loaded on the hair treatment applicator (1) depends upon its size and capacity and the desired end results. The hair treatment applicator (1) may be preferably loaded with an amount of hair treatment composition from about 0.5 gram to about 20 grams, more preferably from about 0.75 gram to about 17 grams, even more preferably from about 1 gram to about 10 grams of hair treatment composition.

Once the hair treatment applicator (1) is loaded with one or more hair treatment compositions, the user holds through the external surfaces (102) of said plate (10) and bottom (201) of said containment portion (20) the hair treatment applicator (1) in one hand, preferably between the thumb and the index finger. Once the user has selected the hair strands to be treated, said hair strand, preferably said bundle of hair strands, is positioned substantially straight between said plate (10) and said containment portion (20) while the applicator (1) is in an open state. Subsequently said applicator (1) is brought into a closed state. While kept in a closed state the hair treatment applicator (1) is swiped along the length of said hair strand, preferably on said bundle of hair strands to apply said one or more hair treatment composition. More preferably said hair treatment applicator (1) is located at the root-line of said hair strand, preferably at the root-line of said bundle of hair strands. The hair treatment composition may also be applied only to limited areas of the hair, i.e. the user can coat only the root-line with the hair treatment composition. The swiping may be repeated more than once, preferably twice.

In certain embodiments a first hair treatment composition is applied to the hair via any of the known conventional methods as a pre- or post-treatment, a second hair treatment composition can be applied via the hair treatment applicator (1) according to the present invention. For example the first hair treatment composition is a dyeing composition to perform a full head colouration and the second hair treatment composition is a highlighting composition used to add variation in colour to the full head coloration. Alternatively a different dyeing composition could be used after the full head colouration to add variation in hair colour. Those skilled in the art would understand that many such combinations of hair treatment compositions may be used to create different results.

Finally, the application of the hair treatment composition may occur on wet or dry hair and optionally, a rinsing or a shampooing step can be included between application of the first and second compositions to the hair.

5. Hair Treatment Compositions, Use Thereof and Kit.

Examples of hair treatment compositions that may be applied via the hair treatment applicator (1) according to present invention are discussed below. Preferably, these compositions are selected from the group consisting of styling compositions, dyeing compositions, highlighting compositions or combination thereof. Each of these hair treatment compositions or combinations thereof may be used to provide a hair strand effect with the hair treatment applicator (1) described above. Preferably said one or more hair treatment compositions have a rheology of from about 10 Pa to about 160 Pa, more preferably of from about 12 Pa to about 120 Pa, most preferably from 15 Pa to 80 Pa at 1 $s^{-1}$.

More preferably, the present invention relates to the use of a highlighting composition with a hair treatment applicator (1) as claimed herein to highlight a hair strand, preferably a bundle of hair strands. Said highlighting composition, preferably, has a rheology of from about 10 Pa to about 160 Pa, more preferably of from about 12 Pa to about 120 Pa, most preferably from 15 Pa to 80 Pa at 1 $s^{-1}$.

The rheology of the hair treatment composition is measured using a TA Instruments Advanced Rheometer (AR) 2000. The instrument is provided with a concentric cylinder base with an internal radius of 15.00 mm and standard size vane geometry with a radius of 14.00 mm and a height of 42.00 mm. The geometry gap is set at 4000 microns. Hair treatment compositions which are made up of more than one formulation are prepared by mixing those various formulations thoroughly by hand shaking in a sample pot for 30 seconds. The mixed hair treatment composition is then placed immediately into the concentric cylinder base, and the standard vane geometry is lowered to the geometry gap such that the top of the vanes are covered by the hair treatment compositions. The temperature is equilibrated to 25° C., and then hair treatment composition is left for an additional 30 seconds before the shear rate increases logarithmically from about 0.05 to about 200 $s^{-1}$, recording seven points per decade. At all stages the temperature is maintained at 25° C. The shear stress is recorded at 1.0 $s^{-1}$ and reported in Pa.

Examples of hair treatment compositions which can be used with the hair treatment applicator (1) according to the invention are indicated below in tables 5, 6 and 7.

The hair treatment compositions may comprise components known, conventionally used, or otherwise effective for use in hair treatment compositions particularly oxidative bleaching and dye compositions which include but are not limited to: developer dye compounds; coupler dye compounds; direct dyes; D&C Orange 4, Acid Yellow 1, D&C Red No. 28, Disperse Red 17, HC Blue No. 15, Acid Blue, oxidizing agents; reducing agents; thickeners; chelants; pH modifiers and buffering agents; alkalising agents, carbonate ion sources and radical scavenger systems; glycine; amodimethicone, ethylenediamine disuccinic acid; anionic, cationic, non-ionic, amphoteric or zwitterionic surfactants, or mixtures thereof, anionic, cationic, non-ionic, amphoteric or zwitterionic polymers, hydrophobically modified polymers or mixtures thereof, fragrances; dispersing agents; solvents, peroxide stabilizing agents; chelants, humectants, proteins and derivatives thereof, plant materials (e.g. aloe, chamomile and henna extracts); silicones (volatile or non-volatile, modified or non-modified), film-forming agents, cellulose polymers and their derivatives, ceramides, preserving agents, gel networks, colour indicators and opacifiers. Some adjuvants which are suitable are listed in the International Cosmetics Ingredient Dictionary and Handbook, (8th ed.; The Cosmetics, Toiletry, and Fragrance Association). Particularly, vol. 2, sections 3 (Chemical Classes) and 4 (Functions) are useful in identifying specific adjuvants to achieve a particular purpose or multipurpose. A representative but not exhaustive list of polymers and thickening agents can be found in "The Encyclopaedia of Polymers and Thickeners for Cosmetics" compiled and edited by Robert Y. Lochhead, PhD and William R. Fron, Department of Polymer Science, University of Southern Mississippi.

The present invention further comprises a kit. Said kit comprises one or more hair treatment applicators (1) as described above and one or more individually packaged hair treatment compositions.

In one embodiment of the present invention, said one or more individually packaged hair treatment compositions comprise a first individually packaged hair treatment composition and a second individually packaged hair treatment composition. When mixed said first and second individually packaged hair treatment compositions form a third hair treatment composition. Examples of such compositions include so called semi-permanent and permanent colorants which typically contain oxidative dyes and an oxidant, and highlighting compositions containing an oxidant and an alkalising agent, optionally with a persulfate salt. Preferably, said first individually packaged composition comprises an oxidizing agent and said second individually packaged composition comprises an alkalizing agent. Preferably, said oxidizing agent is hydrogen peroxide. More preferably, at least one of said first and/or second individually packaged hair treatment composition comprises a persulfate salt.

In one embodiment of the kit according to the present invention said first individually packaged hair treatment composition comprises from 3% to 12% of hydrogen peroxide by weight of said first individually packaged hair treatment composition and said second individually packaged hair treatment composition is in the form of a powder or paste and said second individually packaged hair treatment composition comprises from 10% to 60% of persulfate salt selected from sodium persulfate, potassium persulfate, ammonium persulfate or mixtures thereof, by weight of said second individually packaged hair treatment composition. Said kit optionally comprises a third individually packaged hair treatment composition comprising from 3% to 25% of an alkalizing agent in an aqueous vehicle, by weight of said third individually packaged hair treatment composition.

In another embodiment of the present invention said first individually packaged hair treatment composition comprises from 1.5% to 12% of hydrogen peroxide by weight of said first individually packaged hair treatment composition and said second individually packaged hair treatment composition comprises from 0.01% to 6% of a dye selected from direct dyes, oxidative dye precursors, oxidative dye couplers or mixtures thereof, by weight of said second individually packaged hair treatment composition.

Additional individually packaged hair treatment compositions may be present in the kit-of-part and may comprise shampoos, conditioner or styling products.

Herein below in are given some examples of hair treatment compositions which may be loaded into the hair treatment applicator (1) according to the invention.

A hair bleaching composition was prepared by mixing about 45 g of any of the formulations of Phase 1 (1.1, 2.1, 3.1, 4.1, 5.1, 6.1, 7.1, 8.1 or 9.1, table 5), which were in a liquid form with about 15 g of any of the formulations of Phase 2 (1.2, 2.2, 3.2, 4.2, 5.2, 6.2, 7.2, 8.2 or 9.2 in table 5), which were in a powder form. Mixing was achieved as follows: the powder formulation of Phase 2 was placed into a mixing tray and the liquid formulation of Phase 1 was poured on top of the powder. The two formulations were then mixed together using a spatula to form a bleaching composition. Mixing was completed when the bleaching composition looked visually homogeneous.

TABLE 5

Formulations of Phase 1 and 2 which can be mixed to form a highlighting composition. All ingredients are in percentage by weight of the formulation phase.

| | 1.1 | 2.1 | 3.1 | 4.1 | 5.1 | 6.1 | 7.1 | 8.1 | 9.1 |
|---|---|---|---|---|---|---|---|---|---|
| Phase 1 | | | | | | | | | |
| De-ionized Water | q.s. to 100% | q.s. to 100% | q.s. to 100% | q.s. to 100% | q.s. to 100% | q.s. to 100% | q.s. to 100% | q.s. to 100% | q.s. to 100% |
| Glycerine | 5.00 | | | | | | | | |
| Hydrogen Peroxide (35% Active) | 17.20 | 17.20 | 17.20 | 17.20 | 17.20 | 17.20 | 17.20 | 17.20 | 17.20 |
| Disodium EDTA | 0.04 | 0.04 | 0.04 | 0.04 | 0.04 | 0.04 | 0.04 | 0.04 | 0.04 |
| Carbopol ™ 956[1] | 1.00 | | | | | | | | |
| Sodium Hydroxide (50% aq. Solution) | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 |
| Keltrol ™ T[2] | | | 1.25 | | | | | | |
| Stearyl Alcohol[3] | | 2.00 | | 1.00 | 1.00 | 2.00 | 2.00 | 2.00 | 2.00 |
| Cetyl Alcohol[4] | | 3.00 | | 1.50 | 1.50 | 3.00 | 3.00 | 3.00 | 3.00 |
| Cetearth 25[5] | | 1.50 | | 0.75 | 0.75 | 1.50 | 1.50 | 1.50 | 1.50 |
| Aculyn ™ 33[6] | | | | 2.40 | | | | | |
| Natrosol ™ Plus CS Grade 330[7] | | | | | 1.25 | | | | |
| Salcare ™ SC 90[8] | | | | | | | 1.00 | | |
| Phase 2 | | | | | | | | | |
| Persulfate Powders | 1.2 | 2.2 | 3.2 | 4.2 | 5.2 | 6.2 | 7.2 | 8.2 | 9.2 |
| Ammonium Persulfate | 28.60 | 28.60 | 28.60 | 28.60 | 28.60 | 28.60 | 28.60 | 28.60 | 28.60 |
| Potassium Persulfate | 50.00 | 50.00 | 50.00 | 50.00 | 50.00 | 50.00 | 50.00 | 46.00 | 47.00 |
| Sodium Persulfate | 7.14 | 7.14 | 7.14 | 7.14 | 7.14 | 7.14 | 7.14 | 7.14 | 7.14 |
| Sodium Metasilicate | 14.26 | 14.26 | 14.26 | 14.26 | 14.26 | 14.26 | 14.26 | 14.26 | 14.26 |
| Keltrol T (Xanthan Gum) | | | | | | | | 4.00 | |
| Carbopol ™ Ultrez 10[9] | | | | | | | | | 3.00 |

[1]Carbopol ™ 956, Noveon Inc.

[2]Keltrol ™ T - CP Kelco

[3]Stearyl Alcohol Crodacol S-95, Croda, Inc.

[4]Cetyl Alcohol, Crodacol C-70, Croda, Inc.

[5]Cetearth 25, Cremophor A 25, BASF Corporation

[6]Aculyn ™ 33, Robin and Hass Company Inc.

[7]Natrosol ™ Plus CS Grade 330, Hercules Incorporated

[8]Salcare ™ SC 90 Ciba Specialty Chemicals Corporation

[9]Carbopol ™ Ultrez 10

In another example a bleaching composition was prepared by mixing into a tray with a spatula 30 g of component (a1), in table 6, comprising hydrogen peroxide with 15 g of component (b1), in table 6, comprising persulfate salts. In another example a bleaching composition was prepared as follow: 10 g of component (b2), in table 6, comprising persulfate salts in a powder form were added into a bottle of about 160 ml which already contained about 60 g of component (a2), in table 6. Finally, about 20 g of component (c2), in table 6, comprising ethanolamine, was added to the bottle. The bottle was closed with a cap provided with a nozzle. Mixing was achieved by hand shaking the bottle with the three components till a homogeneous hair bleaching composition was formed.

TABLE 6

Formulations of components (a1), (a2), (b1), (b2) and (c2) which can be mixed to form a highlighting composition. All ingredients are indicated in grams.

| Ingredients | (a1) | (a2) |
|---|---|---|
| Water | 78.54 | 67.34 |
| hydrogen peroxide (35% active) | 17.14 | 25.71 |
| Cetearyl alcohol[10] | 2.25 | |
| trideceth 2 carboxamide MEA[11] | 0.85 | |
| ceteareth-30[12] | 0.60 | |
| glycerin | 0.50 | |
| pentasodium pentetate[13] | 0.06 | |
| sodium stannate | 0.04 | |
| tetrasodium pyrophosphate | 0.02 | |
| Cetearyl Alcohol (and) Ceteareth-20[14] | | 1.50 |
| Glyceryl Stearate[15] | | 4.00 |
| Oleth-10[16] | | 0.30 |
| Oleth-2[17] | | 0.30 |
| Stearamidopropyl Dimethylamine[18] | | 0.60 |
| Etidronic Acid | | 0.25 |

| Ingredients | (b1) | (b2) |
|---|---|---|
| potassium persulfate | 42.8 | 35.0 |
| sodium silicate | 22.5 | 35.0 |
| sodium persulfate | 11 | |
| Ammonium persulfate | | 27.5 |
| acrylates/C10-30 alkyl acrylate crosspolymer[19] | 4.3 | |
| Urea | 3.0 | |
| Kaolin | 2.9 | |
| Magnesium Stearate[20] | 2.8 | |
| Ammonium Chloride | 2.6 | |
| diethylhexyl sodium sulfosuccinate[21] | 2.0 | |
| VP/VA copolymer[22] | 2.0 | |
| Polydecene[23] | 1.7 | |
| Sodium lauryl sulfate[24] | | 1.5 |
| sodium metasilicate | 1.6 | |
| EDTA | 0.8 | 1.0 |

| Ingredients | (c2) |
|---|---|
| Water | 56.3 |
| Ethanolamine | 15.0 |
| Cetearyl alcohol/hydroxyethyl behenamidopropyl dimonium chloride/hexylene glycol[25] | 2.5 |
| Cocamide MEA[26] | 12.0 |
| Dilinoleic acid[27] | 4.0 |
| Disodium wheatgermamphodiacetate[28] | 3.0 |
| Linoleamidopropyl dimethylamine dimer dilinoleate[29] | 2.0 |
| Stearamide MEA[30] | 4.0 |
| Sodium sulfite | 0.5 |

TABLE 6-continued

Formulations of components (a1), (a2), (b1), (b2) and (c2) which can be mixed to form a highlighting composition. All ingredients are indicated in grams.

| | |
|---|---|
| EDTA | 0.2 |
| Erythorbic acid | 0.5 |

[10]Cetearyl alcohol - Crodacol CS-50, Croda Inc
[11]Trideceth 2 carboxamide MEA - Aminol A 15, Kao Chemicals GmbH
[12]Ceteareth-30 - Eumulgin ™ B 3, Cognis GmbH
[13]Pentasodium pentetate - Versenex 80, Dow Chemicals
[14]Cetearyl Alcohol (and) Ceteareth-20 - Crodex N, Croda Inc
[15]Glyceryl Stearate - Cithrol GMS 0400, Croda Inc
[16]Oleth-10 - Volpo 10, Croda Inc.
[17]Oleth-2 - Volpo N2, Croda Inc.
[18]Stearamidopropyl Dimethylamine - Incromine SB, Croda Inc.
[19]Acrylates/C10-30 alkyl acrylate crosspolymer, Carbopol ™ Ultrez 20, Noveon Inc.
[20]Magnesium Stearate - Radiastar ™ 1100, Oleon NV
[21]Diethylhexyl sodium sulfosuccinate, Geropon SS-0-75, Rhodia Inc.
[22]VP/VA copolymer - Luviskol ™ VA73E BASF Corporation
[23]Polydecene - Puresyn ™ 1000 ExxonMobil Chemical Company
[24]Sodium lauryl sulfate - Empicol LX32, Albright and Wilson UK Ltd
[25]Cetearyl alcohol/hydroxyethyl behenamidopropyl dimonium chloride/hexylene glycol, Incroquat Behenyl HE, Croda Inc.
[26]Cocamide MEA, Amidex CME, Rhodia.
[27]Dilinoleic acid, Empol 1008, Cognis Corporation
[28]Disodium wheatgermamphodiacetate, Mackam 2W, McIntyre Group Ltd
[29]Linoleamidopropyl dimethylamine dimer dilinoleate, Necon LO-80, Alzo/Bernal Chemical
[30]Stearamide MEA Rewomid S280, Degussa Care and Surface Specialities In another example a dying composition containing direct dyes as indicated in table 7, formulation (a4), may be used directly with no preparation step required.

In a further example, a dying composition comprising oxidative dyes was prepared by mixing in a bottle by vigorous shaking about 60 g of formulation (a5), in table 7, with about 60 g of formulation (b5), in table 7.

TABLE 7

Dyeing composition (a4) and formulations (a5) and (b5) which can be mixed to form a dying composition comprising oxidative dyes. All ingredients are indicated in grams.

| Ingredients | (a4) | a5 |
|---|---|---|
| Water | 95.49 | 66.45 |
| Ammonium hydroxide 31.9% solution | | 6.00 |
| Oleth-10[31] | | 4.00 |
| C12-15 Pareth-3[32] | | 2.50 |
| Steareth-21[33] | | 4.00 |
| Dilinoleic Acid[34] | | 3.50 |
| Cocamide MEA[35] | | 4.00 |
| Behentrimonium Chloride[36] | | 2.60 |
| Linoleamidopropyl Dimethylamine Dimer Dilinoleate[37] | | 3.00 |
| Erythorbic Acid | | 0.40 |
| Sodium Sulfite | | 0.25 |
| EDTA acid | | 0.05 |
| Sodium Sulfate | | 0.50 |
| M-Aminophenol[38] | | 0.50 |
| 1-Naphthol[39] | | 0.25 |
| Resorcinol[40] | | 1.00 |
| P-Phenylenediamine[41] | | 0.75 |
| P-Aminophenol[42] | | 0.25 |
| HC Yellow No. 2[43] | 0.20 | |
| Disperse Black 9[44] | 0.05 | |
| HC Red No. 3[45] | 0.15 | |
| Disperse Violet 1[46] | 0.05 | |
| Erythorbic Acid | 0.025 | |
| Citric Acid | 0.50 | |
| Ethanolamine | 2.50 | |
| Carbopol 956[47] | 0.83 | |
| HC Orange No. 1[48] | 0.205 | |

TABLE 7-continued

| Dyeing composition (a4) and formulations (a5) and (b5) which can be mixed to form a dying composition comprising oxidative dyes. All ingredients are indicated in grams. | |
|---|---|
| Ingredients | (b5) |
| Water | 82.84 |
| Hydrogen peroxide (35% active) | 17.14 |
| Etidronic Acid | 0.02 |

[31]Oleth-10 - Volpo 10, Croda Inc.
[32]C12-15 Pareth-3, Neodol 25-3, Shell Chemical Company
[33]Steareth-21 - Cromul EM1207, Croda Inc
[34]Dilinoleic Acid - Empol 1008, Cognis Corporation
[35]Cocamide MEA - Amidex CME, Rhodia.
[36]Behentrimonium Chloride - Incroquat Behenyl TMC-85 - Croda Inc.
[37]Linoleamidopropyl Dimethylamine Dimer Dilinoleate - Necon LO-80, Alzo/Bernal Chemical
[38]M-Aminophenol - Rodol EG, Jos. H. Lowenstein & Sons, Inc.
[39]1-Naphthol - Rodol ERN, Jos. H. Lowenstein & Sons, Inc.
[40]Resorcinol - Rodol RS, Jos. H. Lowenstein & Sons, Inc.
[41]P-Phenylenediamine - Rodol D, Jos. H. Lowenstein & Sons, Inc.
[42]P-Aminophenol Rodol P Base(Jos. H. Lowenstein & Sons, Inc.
[43]HC Yellow No. 2 - Velsol Yellow 2, Clariant Corporation
[44]Disperse Black 9 - Lowadene Black 9, Jos. H. Lowenstein & Sons, Inc.
[45]HC Red No. 3 - Velsol Red 3, Clariant Corporation
[46]Disperse Violet 1 - Lowadene Violet 1, Jos. H. Lowenstein & Sons, Inc.
[47]Carbopol 956, Noveon Inc.
[48]HC Orange No. 1 - Colorex HCO1, Chemical Compounds Inc.

The kit according to the present invention may further comprise additional components such as means to select the hair strands, combs or brushes, gloves, caps with holes, tweezers, tongues, hooks or combination thereof.

The kit according to the present invention may further comprise instructions for using at least one component of the kit according to the invention. Preferably, said kit may comprise instructions for consumers indicating how to load and/or use components of said kit, said instructions being recorded in any type of media such as the package of the kit itself, paper material, compact disk, DVD, website address, or the dispensing means and/or the hair treatment applicator (1) itself.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments or the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hair treatment applicator for applying a hair treatment composition to the hair, wherein said applicator comprises a plate and a containment portion;

wherein said plate comprises a perimeter, a substantially flat internal surface comprising a centre, and an external surface; wherein said plate comprises at least one member, which projects from said substantially flat internal surface; wherein said member is continuous and liquid impervious; wherein said member has a proximal base and a distal base wherein said proximal base is attached to said substantially flat internal surface of said plate and wherein said distal base comprises an edge; and wherein said containment portion comprises a bottom and a wall, said wall emerging from said bottom and extending upwardly, said wall having a rim and said rim defining an opening and an internal volume of said containment portion; and wherein said plate and said containment portion are movably joined by a connection so that said applicator may alternate between a closed state and an open state, wherein when said applicator is in the closed state, said substantially flat internal surface of said plate is in a juxtaposed relationship to said opening of said containment portion and wherein when said applicator is in the open state, said substantially flat internal surface of said plate is in a distal relationship to said opening of said containment portion; and wherein when said hair treatment applicator is in said closed state, at least a part of said member is within said internal volume of said containment portion; wherein said substantially flat internal surface of said plate comprises an axis Y, wherein said axis Y extends substantially straight from the centre of said substantially flat internal surface of said plate and crosses transversally said connection, wherein said member extends along said axis Y.

2. The applicator according to claim 1, wherein said member has a maximum length (L); a maximum height (H); a maximum width (W); wherein said member extends along said substantially flat internal surface of said plate with said maximum length (L) and with said maximum width (W).

3. The applicator according to claim 1, wherein when said applicator is in a closed state, the average distance (D1) between said substantially flat internal surface of said plate and said rim of said wall of said containment portion is from about 0.5 mm to about 5.0 mm

4. The applicator according to claim 1, wherein said applicator comprises a plane (P1) on which said rim of said wall lays; wherein when said applicator is in a close state, said applicator further comprises at least one segment (S1); wherein said segment (S1) is formed by the edge of said distal base of said member and said rim of said wall of said containment portion; wherein said plane (P1) and said segment (S1) form at least one angle $\phi$ of from about 15° to about 55°.

5. The applicator according to claim 1, wherein said member has a pyramidal frustum form.

6. The applicator according to claim 1, wherein said edge is curvilinear.

7. The applicator according to claim 1, wherein said perimeter of said plate has substantially the same extension of said rim of said wall of said containment portion.

8. The applicator according to claim 1, wherein said connection has a fulcrum, wherein said fulcrum is located adjacent to said perimeter of said plate and to said rim of said containment portion.

9. A kit comprising a hair treatment applicator according to claim 1; and one or more individually packaged hair treatment compositions.

10. The kit according to claim 9, wherein said one or more individually packaged hair treatment compositions comprises at least a first and a second individually packaged hair treatment composition, wherein said first and second individually packaged hair treatment composition are mixed to form a third hair treatment composition, wherein said first individually packaged hair treatment composition comprises an oxidizing agent and wherein said second individually packaged hair treatment composition comprises an alkalizing agent.

11. The kit according to claim 9, further comprising instructions for using said hair treatment applicator.

* * * * *